United States Patent [19]

Löf

[11] 4,251,889

[45] Feb. 24, 1981

[54] SWIMMING POOL COVER

[75] Inventor: Lance Löf, Denver, Colo.

[73] Assignee: Solaron Corporation, Englewood, Colo.

[21] Appl. No.: 67,805

[22] Filed: Aug. 20, 1979

[51] Int. Cl.[3] ..... E04H 3/16; E04H 3/18

[52] U.S. Cl. ..... 4/498; 4/503

[58] Field of Search ..... 4/172, 172.12, 172.13, 4/172.14, 488, 494, 498, 499

[56] References Cited

U.S. PATENT DOCUMENTS

| | | | |
|---|---|---|---|
| 2,870,455 | 1/1959 | Reeves | 4/172.12 |
| 2,964,759 | 12/1960 | Riggs | 4/498 |
| 3,916,457 | 11/1975 | Morita | 4/172.12 |
| 3,940,809 | 3/1976 | Hughes | 4/172.12 |
| 4,135,257 | 1/1979 | Löf | 4/172.12 |
| 4,146,015 | 3/1979 | Acker | 4/172.12 |

FOREIGN PATENT DOCUMENTS

| | | | |
|---|---|---|---|
| 1227837 | 3/1960 | France | 4/172.12 |

*Primary Examiner*—Henry K. Artis

*Attorney, Agent, or Firm*—Richard D. Law

[57] ABSTRACT

A swimming pool cover consisting of a sheet of transparent, flexible, pliant plastic of a size to cover the water surface of a pool with an overhang of a several inches permitting folding back all edges, a foamed plastic cylinder in the fold around the pool periphery and a plurality of tubular clamps maintaining the folded edge around the foamed plastic cylinder.

5 Claims, 7 Drawing Figures

SWIMMING POOL COVER

This invention relates to a sheet of plastic film of the size of the surface of a swimming pool, with a peripheral edge overhang so that the peripheral edge may be turned back on the sheet around a foamed plastic, elongated cylinder and temporarily held in place by tubular clips closely spaced around the edge.

BACKGROUND OF THE INVENTION

It is known that a cover for an outdoor swimming pool generally keeps the pool cleaner than an uncovered pool. Also, translucent or transparent pool covers tend to permit the sun's rays to enter the water, heating the same. Covers, furthermore, tend to reduce evaporation and conserve the latent heat in the water. Thus, pool covers are beneficial. A number of pool covers are available, but they are usually custom made, and are rather expensive. Being exposed to the weather, particularly the sun, the covers do not have a long life.

Priorly, a number of patents have shown various types of custom pool covers. For example, U.S. Pat. No. 3,600,721 to Pusey of Aug. 24, 1971 shows a pool cover formed of a plastic film cut to the shape of the water surface. The cover is made flotable by securing to the sheet periphery air inflatable tubes, usually of the same material as the cover film. The tubes are usually welded to the edge, or the edge may be folded back on itself and welded to form airtight tubes. The manufacture of the cover is a custom job, requiring special equipment to form the tubes and weld the tubes to the plastic film.

U.S. Pat. No. 3,940,809 to Huges, dated Mar. 2, 1976, also, uses an air filled, endless plastic loop around the pool cover material. This again requires a custom made cover with special tools and equipment.

A cover larger than the pool is shown in U.S. Pat. No. 3,732,581 to Petti of May 15, 1973, using elongated water bags secured to the edge of the plastic material of the cover, which is larger than the pool surface.

A series of unconnected, small discs are shown in U.S. Pat. No. 3,984,882, providing a series of small, individual solar panels. These panels do not and can not cover the entire surface as they are round and in abutting position leave a substantial surface area uncovered.

French Pat. No. 660,246 of Feb. 25, 1965 shows a series of rigid panels interconnected so that fold up in an accordian fold. The rigid panels cover the pool surface, but obviously must be custom made.

THE INVENTION

The present invention provides a pool cover which is arranged to be sold as an off-the-shelf kit. The plastic film of the cover is sold in a few rectangular sizes and is easily cut to a pool's dimensions. The flotation equipment according to the invention is easily and simply applied. The kit is ideal for pool owners since assembly of the kit is so simple. The flotation device for the film is an elongated extruded foamed plastic cylinder with closed cells, making it waterproof. The plastic film is easily cut with a knife or scissors to the shape of the pool with a 2–4 inch overhang. The overhang edge is turned back on itself over the foamed plastic cylinder, and tubular clips, spaced fairly close together, over the turned back edge and the cylinder holds the foamed plastic in place and provides flotation for the film, holds it against the pool edge and tends to spread the film over the surface of the pool.

OBJECTS AND ADVANTAGES OF THE INVENTION

Included among the objects and advantages of the invention is to provide a simple and effecient pool cover for swimming pool.

Another object of the invention is to provide a pool cover kit which may be assembled by pool owners with only a knife or scissors.

Still another object of the invention is to provide a swimming pool cover which may be easily assembled for use or disassembled for storage with on tools.

A further object of the invention is to provide a swimming pool cover in a kit form to dispense with factory custom-made pool covers, and to utilize only a few sizes of rectangular plastic film for the kits.

Yet another object of the invention is to provide a swimming pool cover which may be assembled and disassembled without tools.

An additional object of the invention is to provide a plastic film swimming pool cover having edge flotation equipment which conforms to the pool configuration completely covering the surface of the water and which tens to spread on the water into contact with the pool walls.

These and other objects and advantages of the invention may be ascertained by reference to the following description and appended illustrations.

GENERAL DESCRIPTION OF THE DRAWINGS

SPECIFIC DESCRIPTION OF THE DRAWINGS

Figure 1:
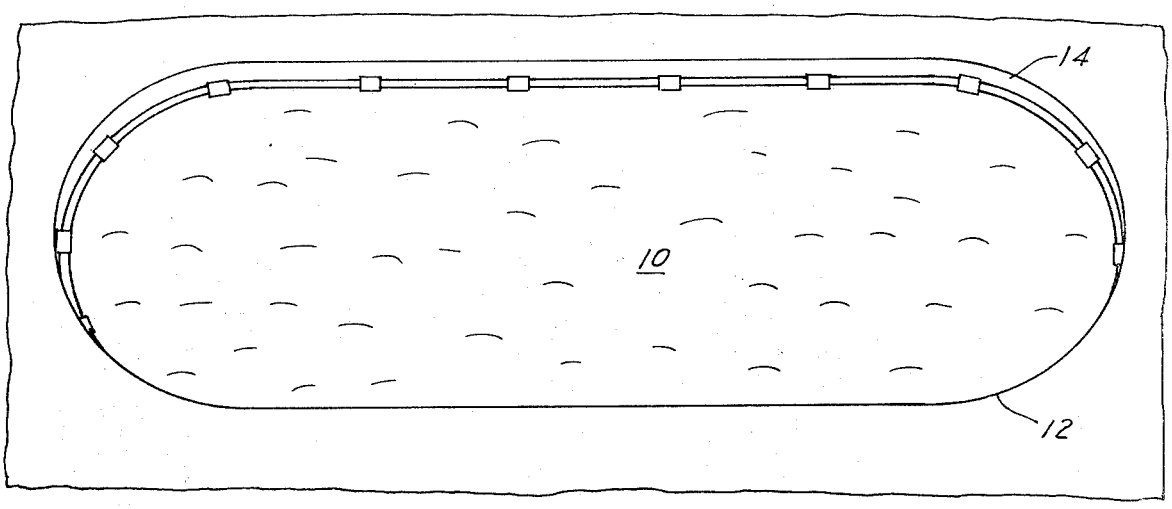
FIG. 1 is schematic perspective view of a swimming pool with a cover according to the invention.
Figure 2:
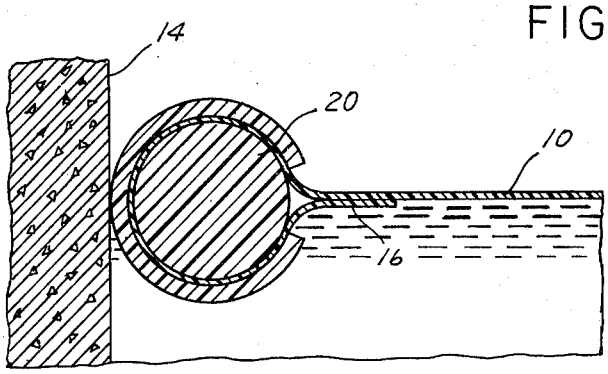
FIG. 2 is an enlarged, cross-sectional side elevation of flotation equipment for the edge of the pool cover.
Figure 3:
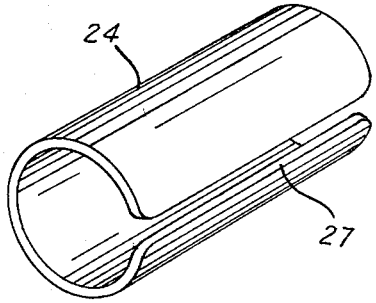
FIG. 3 is a perspective view of one form of holding clip for the plastic film around a flotation cylinder.
Figure 4:
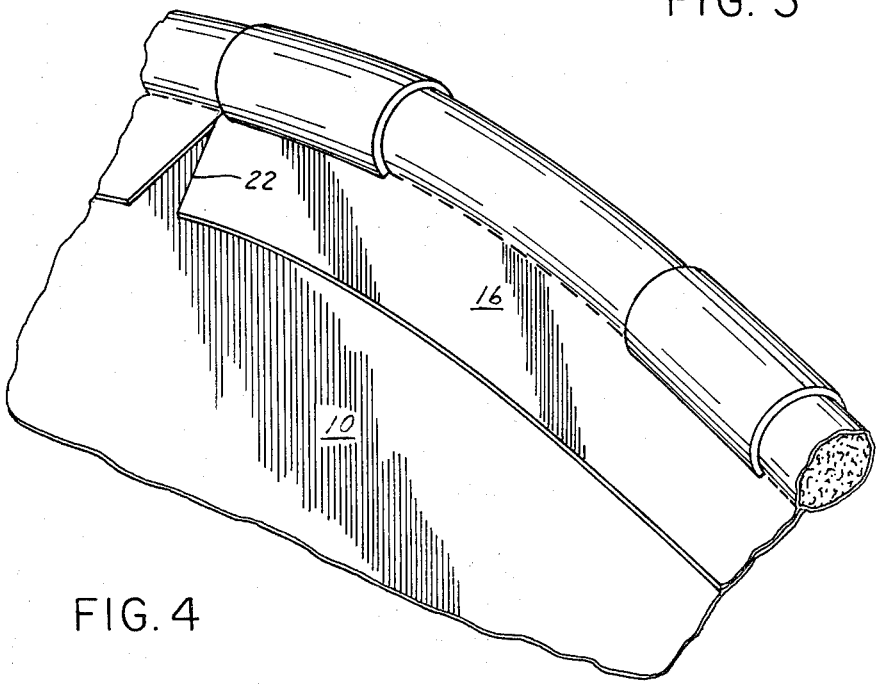
FIG. 4 is an enlarged, schematic perspective view of a portion of the pool cover of the invention.

The pool covering material preferred, utilizing the invention, is a plastic film, usually in the 4–10 mil thick range, and preferably about 6 mils. The film is preferably manufactured with an ultra-violet light protector providing a long life for the film. Such films are flexible and pliant, and formed of such synthetic resins as polyethylene, polyvinyl, polyurethane, etc. Film with a high plasticizer content is useful for the invention. The flotation device for the edge of the pool cover is preferably an extruded, foamed plastic cylinder having closed cells. Some useful forms of extruded foam includes, integrated-skin urethane foam; polyethylene foam of the low density extruded form; etc. A commercially available extruded back-up rod for caulking sealants has been found to be excellant material for flotation, as it may be obtained in a great variety of diameters.

The pool cover shown in FIGS. 1–4 includes a flexible, pliant film 10 which is cut to the size of a pool 12, with a 2–6 inch overhang of the exact dimensions of the water surface edge around the pool wall 14. The edge of the film is turned back on itself forming a type of hem 16, around an elongated cylindrical foamed plastic member 20. The edge, on turning back, may have a few darts cut in it, as at 22, so that the edge does not wrinkle, a familiar technique is sewing. The edge is only turned back far enough so that the plastic touches the wall 14. The foamed plastic cylinder is held in place by a series of clips 24 spaced every few inches around the entire periphery of the film. The clip is a tubular member, one valuable type is a polyethylene tube, being flexible and resilient enough to be capable of sustaining itself in tubular configuration under stress, but having a memory to quickly return to tubular form if deformed out tubular shape. The short length of tube is split axially along a line 23, and with rounded corners to dispense with sharp edges and corners.

One valuable size of foamed, extruded back-up rod is about $\frac{5}{8}$" diameter rod, and a $\frac{5}{8}$ inside diameter polyethylene tube about 1–3 inches long makes an excellant clip for holding the rod in the turned back edge.

Usually the pool cover including the plastic film is sold in kit form of a particular size, with sufficient foamed rod and clips to make a cover for the largest cover formable from the sheet of rectangular plastic film. The sheet of plastic film is preferably rectangular, and the cut-off edge portions may be discarded or used for other purposes. As an example, a kit is provided with a 20 foot by 40 foot rectangular sheet, which is satisfactory, without too much waste, for a large variety of sizes and shapes of pools. The kit contains about 100 feet of foamed rod and some 80 to 100 clips. The plastic sheet is layed out over the pool, and is simply and easily cut to size and shape of the pool, i.e. the pool surface with a 2–6 inch overhang. The foamed rod is added by turning the edge back over the rod and adding the clips every few inches-usually 4–12 inches. The foamed plastic rod is flexible so it may easily assume the arc of the side of a curved pool, or bend out a right angle for square corners. At the end of the season, the cover is easily disassembled, the plastic sheet dried and folded for storage.

Figure 5:
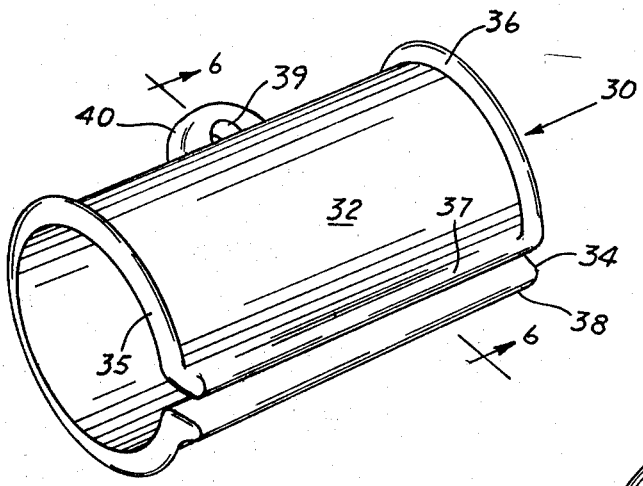
FIG. 5 is perspective view of a modified form of edge holding clip according to the invention.
Figure 6:
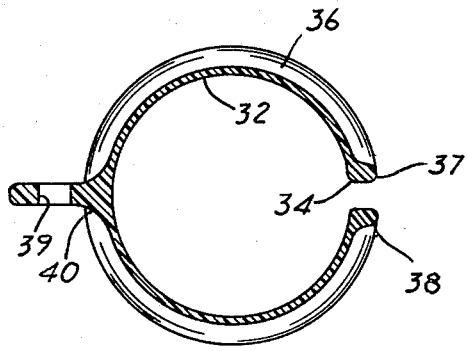
FIG. 6 is a cross-sectional view of the clip of FIG. 5.

In some instances, an edge reinforced clip is useful for tightly binding the plastic sheet to the rod. As shown in FIG. 5, a clip 30 having a tubular body 32 and an axial slit 34 has reinforcing ridges 35 around a first opening in the tube and ridges 36 around the opposte end. The axial slit may, also include ridges 37 and 38. These ridges, of the same material, add strength to the clip and provide rounded edges which do not cut into the plastic sheet. Further, such clips may be readily injection molded.

For some purposes, it is helpful to have one edge of a pool cover secured, even though it is loosely secured. This aids in pulling the pool cover onto the surface of the water. A few ropes or cords tied to end edge greatly aids in putting the pool cover on the pool. Such ties may be effectively secured to the clips, for example, an eyelet 39 in boss 40 provides a tie down point for a rope or cord.

Figure 7:
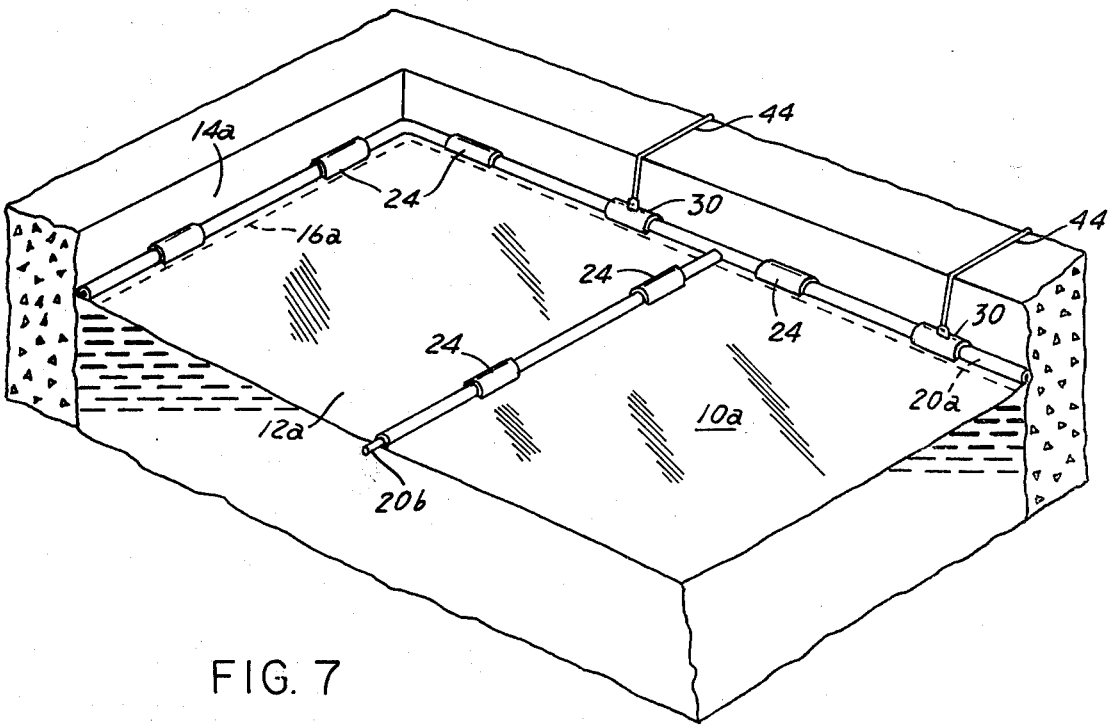
FIG. 7 is perspective of a portion of the swimming pool showing edge flotation equipment as well as center flotation equipment, and the use of the modified clips.

As shown in FIG. 7, a cover 10*a* with an edge 16*a* turned back over a foamed plastic rod 40*a* aforms a cover for a pool 12*a*, covering the water surface up to the walls 14*a*. Clips 24 holds the plastic on the flotation rod. A few clips 30 secured over the flotation rod at spaced intervals along one edge of the cover provides ties for cords 44, which are secured or anchored by the free end (not shown). This aids in covering on or off the pool, particularly by one person.

Additional flotation and spreading strength for the plastic film, may be achieved by inserting a flotation rod 20*b* in the plastic sheet generally from side to side, and spaced from each edge. The rod is held by clips 24 in the same manner as long as the edge. The rod is placed under the plastic sheet and after the sheet is squeezed around it, the clips are added. Since the rod is of closed cells, it does not take up water. Also since it extend across the pool it tends to spread the plastic across the pool.

While the invention has been described by reference to a particular design, obvious substitution may be made by those skilled in the art, and such are intended to be included in the spirit and scope of the invention.

What is claimed is:

1. A swimming pool cover for easy assembly and disassembly for floating on the surface of the water in a swimming pool, comprising (a) a sheet of flexible, resilient, pliable synthetic plastic film which is essentially water proof and of the size and shape of the water surface area of the swimming pool with an extension of from 3 to 12 inches extending from the plastic film edge beyond the peripheral line of the water area, (b) a closed cell, flexible foamed plastic rod of the length of the periphery of the water area arranged for extending around said plastic film with said extension folded back over said plastic rod onto said plastic film, and (c) a plurality of tubular, slit synthetic plastic clips arranged to be temporarily, spacedly secured around said plastic film and temporarily encompassing said plastic rod holding the same on the plastic film at the periphery of the water area, forming a floating pool cover of the size and shape of the pool water area with the edge thereof abutting the walls of the swimming pool.

2. A swimming pool cover for easy assembly and disassembly according to claim 1, wherein said plastic rod is an extruded, closed cell foamed rod extending around said plastic film adjacent the periphery thereof.

3. A swimming pool cover for easy assembly and disassembly according to claim 1, wherein said clips are short sections of a semi-rigid synthetic plastic tube with the tube wall cut axially to form a clip.

4. A swimming pool cover for easy assembly and disassembly according to claim 1, wherein said clips are short, tubular plastic members having an axial slit in the tube wall with the slit and the tube openings being reinforced for more secure holding.

5. A swimming pool cover for easy assembly and disassembly according to claim 1, wherein said sheet of plastic film is generally rectangular and of a size and shape to completely cover said pool and to be easily cut to the size of the peripheral edge of the water of the pool with said extension, packaged with said plastic rod and said plurality of clips as a kit.

* * * * *